US007425145B2

(12) United States Patent
Ngo

(10) Patent No.: US 7,425,145 B2
(45) Date of Patent: Sep. 16, 2008

(54) CONNECTORS AND CONTACTS FOR TRANSMITTING ELECTRICAL POWER

(75) Inventor: Hung Viet Ngo, Harrisburg, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/441,856

(22) Filed: May 26, 2006

(65) Prior Publication Data

US 2007/0275586 A1 Nov. 29, 2007

(51) Int. Cl.
*H01R 25/00* (2006.01)

(52) U.S. Cl. ..... 439/290; 439/79; 439/295; 439/857

(58) Field of Classification Search ..... 439/290, 439/65, 856, 79, 660, 857, 858, 295
See application file for complete search history.

(56) References Cited

U.S. PATENT DOCUMENTS

| | | | | |
|---|---|---|---|---|
| 318,186 | A | 5/1885 | Hertzog | |
| 741,052 | A * | 10/1903 | Mahon | 200/51.1 |
| 1,477,527 | A | 12/1923 | Raettig | |
| 2,248,675 | A | 7/1941 | Huppert | 113/119 |
| 2,430,011 | A | 11/1947 | Gillentine | 173/361 |
| 2,759,163 | A | 8/1956 | Ustin et al. | 339/217 |
| 2,762,022 | A | 9/1956 | Benander et al. | 339/47 |
| 2,844,644 | A | 7/1958 | Soule, Jr. | 174/35 |
| 3,011,143 | A | 11/1961 | Dean | 339/49 |
| 3,178,669 | A | 4/1965 | Roberts | 339/49 |
| 3,208,030 | A | 9/1965 | Evans et al. | |
| 3,286,220 | A | 11/1966 | Marley et al. | 439/680 |
| 3,411,127 | A | 11/1968 | Adams | 339/47 |
| 3,420,087 | A | 1/1969 | Hatfield | |
| 3,514,740 | A | 5/1970 | Filson | 439/290 |
| 3,538,486 | A | 11/1970 | Shlesinger, Jr. | 439/268 |
| 3,634,811 | A | 1/1972 | Teagno et al. | 339/47 |
| 3,669,054 | A | 6/1972 | Desso et al. | 113/119 |
| 3,692,994 | A | 9/1972 | Hirschmann et al. | 240/11.4 |
| 3,748,633 | A | 7/1973 | Lundergan | 339/217 |
| 3,845,451 | A * | 10/1974 | Neidecker | 439/295 |
| 3,871,015 | A | 3/1975 | Lin et al. | 357/67 |
| 3,942,856 | A | 3/1976 | Mindheim et al. | 439/34 |
| 3,972,580 | A | 8/1976 | Pemberton et al. | 339/47 |
| 4,070,088 | A | 1/1978 | Vaden | 339/252 |

(Continued)

FOREIGN PATENT DOCUMENTS

| | | |
|---|---|---|
| DE | 1 665 181 | 4/1974 |

(Continued)

OTHER PUBLICATIONS

Finan, J.M., "Thermally Conductive Thermoplastics", LNP Engineering Plastics, Inc., Plastics Engineering 2000, www.4spe.org, 4 pages.

(Continued)

*Primary Examiner*—Tho D. Ta
*Assistant Examiner*—Travis Chambers
(74) *Attorney, Agent, or Firm*—Woodcock Washburn LLP

(57) ABSTRACT

A connector system includes a first connector, and a second connector that mates with the first connector. The same type of power contact is used in the first and second connectors.

15 Claims, 13 Drawing Sheets

U.S. PATENT DOCUMENTS

| | | | | | |
|---|---|---|---|---|---|
| 4,076,362 | A | | 2/1978 | Ichimura | 339/75 |
| 4,136,919 | A | | 1/1979 | Howard et al. | 439/346 |
| 4,159,861 | A | | 7/1979 | Anhalt | 339/75 |
| 4,217,024 | A | | 8/1980 | Aldridge et al. | 339/275 |
| 4,260,212 | A | | 4/1981 | Ritchie et al. | 339/97 |
| 4,288,139 | A | | 9/1981 | Cobaugh et al. | 339/74 |
| 4,371,912 | A | | 2/1983 | Guzik | 361/417 |
| 4,383,724 | A | | 5/1983 | Verhoeven | 439/510 |
| 4,402,563 | A | | 9/1983 | Sinclair | 339/75 |
| 4,403,821 | A | | 9/1983 | Zimmerman, Jr. et al. | 339/97 |
| 4,505,529 | A | | 3/1985 | Barkus | 439/82 |
| 4,536,955 | A | | 8/1985 | Gudgeon | 29/840 |
| 4,545,610 | A | | 10/1985 | Lakritz et al. | 29/589 |
| 4,552,425 | A | * | 11/1985 | Billman | 439/295 |
| 4,560,222 | A | | 12/1985 | Dambach | 339/75 |
| 4,564,259 | A | | 1/1986 | Vandame | 339/258 |
| 4,596,433 | A | | 6/1986 | Oesterheld et al. | 339/112 |
| 4,685,886 | A | * | 8/1987 | Denlinger et al. | 439/55 |
| 4,717,360 | A | | 1/1988 | Czaja | 439/710 |
| 4,767,344 | A | | 8/1988 | Noschese | 439/83 |
| 4,776,803 | A | | 10/1988 | Pretchel et al. | 439/59 |
| 4,815,987 | A | | 3/1989 | Kawano et al. | 439/263 |
| 4,820,182 | A | | 4/1989 | Harwath et al. | 439/290 |
| 4,867,713 | A | | 9/1989 | Ozu et al. | 439/833 |
| 4,878,611 | A | | 11/1989 | LoVasco et al. | 228/180.2 |
| 4,881,905 | A | | 11/1989 | Demler, Jr. et al. | 439/79 |
| 4,900,271 | A | | 2/1990 | Colleran et al. | 439/595 |
| 4,907,990 | A | | 3/1990 | Bertho et al. | 439/851 |
| 4,963,102 | A | * | 10/1990 | Gettig et al. | 439/291 |
| 4,973,257 | A | | 11/1990 | Lhotak | 439/81 |
| 4,973,271 | A | | 11/1990 | Ishizuka et al. | 439/839 |
| 5,024,610 | A | * | 6/1991 | French et al. | 439/857 |
| 5,035,639 | A | * | 7/1991 | Kilpatrick et al. | 439/290 |
| 5,052,953 | A | | 10/1991 | Weber | 439/857 |
| 5,066,236 | A | | 11/1991 | Broeksteeg | 439/79 |
| 5,077,893 | A | | 1/1992 | Mosquera et al. | 29/882 |
| 5,082,459 | A | | 1/1992 | Billman et al. | 439/637 |
| 5,094,634 | A | | 3/1992 | Dixon et al. | 431/751 |
| 5,104,332 | A | | 4/1992 | McCoy | 439/290 |
| 5,174,770 | A | | 12/1992 | Sasaki et al. | 439/108 |
| 5,214,308 | A | | 5/1993 | Nishiguchi | 257/692 |
| 5,238,414 | A | | 8/1993 | Yaegashi et al. | 439/108 |
| 5,254,012 | A | | 10/1993 | Wang | 439/263 |
| 5,274,918 | A | | 1/1994 | Reed | 29/882 |
| 5,276,964 | A | | 1/1994 | Anderson, Jr. et al. | |
| 5,302,135 | A | | 4/1994 | Lee | 439/263 |
| 5,381,314 | A | | 1/1995 | Rudy, Jr. et al. | 361/712 |
| 5,400,949 | A | | 3/1995 | Hirvonen et al. | 228/180.22 |
| 5,427,543 | A | | 6/1995 | Dynia | 439/346 |
| 5,431,578 | A | | 7/1995 | Wayne | 439/259 |
| 5,457,342 | A | | 10/1995 | Herbst, II | 257/712 |
| 5,475,922 | A | | 12/1995 | Tamura et al. | 29/881 |
| 5,490,040 | A | | 2/1996 | Gavdenzi et al. | 361/773 |
| 5,533,915 | A | | 7/1996 | Deans | 439/678 |
| 5,558,542 | A | | 9/1996 | O' Sullivan et al. | 439/682 |
| 5,577,928 | A | * | 11/1996 | Duclos | 439/290 |
| 5,582,519 | A | | 12/1996 | Buchter | |
| 5,588,859 | A | | 12/1996 | Maurice | 439/290 |
| 5,590,463 | A | | 1/1997 | Feldman et al. | 29/844 |
| 5,609,502 | A | | 3/1997 | Thumma | 439/747 |
| 5,618,187 | A | | 4/1997 | Goto | 439/79 |
| 5,637,008 | A | | 6/1997 | Kozel | 439/342 |
| 5,643,009 | A | | 7/1997 | Dinkel et al. | |
| 5,664,973 | A | | 9/1997 | Emmert et al. | 439/862 |
| 5,691,041 | A | | 11/1997 | Frankeny et al. | 428/209 |
| 5,702,255 | A | | 12/1997 | Murphy et al. | 439/71 |
| 5,730,609 | A | | 3/1998 | Harwath | 439/108 |
| 5,741,144 | A | | 4/1998 | Elco et al. | 439/101 |
| 5,741,161 | A | | 4/1998 | Cahaly et al. | 439/709 |
| 5,742,484 | A | | 4/1998 | Gillette et al. | 361/789 |
| 5,743,009 | A | | 4/1998 | Matsui et al. | 29/843 |
| 5,745,349 | A | | 4/1998 | Lemke | 361/818 |
| 5,746,608 | A | | 5/1998 | Taylor | 439/70 |
| 5,755,595 | A | | 5/1998 | Davis et al. | 439/607 |
| 5,772,451 | A | | 6/1998 | Dozier, II et al. | 439/70 |
| 5,787,971 | A | | 8/1998 | Dodson | 165/121 |
| 5,795,191 | A | | 8/1998 | Preputnick et al. | 439/608 |
| 5,810,607 | A | | 9/1998 | Shih et al. | 439/66 |
| 5,817,973 | A | | 10/1998 | Elco et al. | 174/32 |
| 5,831,314 | A | | 11/1998 | Wen | 257/391 |
| 5,857,857 | A | | 1/1999 | Fukuda | 439/188 |
| 5,874,776 | A | | 2/1999 | Kresge et al. | 257/747 |
| 5,876,219 | A | | 3/1999 | Taylor et al. | 439/74 |
| 5,876,248 | A | | 3/1999 | Brunker et al. | |
| 5,883,782 | A | | 3/1999 | Thurston et al. | 364/704 |
| 5,888,884 | A | | 3/1999 | Wojnarowski | 438/462 |
| 5,908,333 | A | | 6/1999 | Perino et al. | 439/631 |
| 5,919,050 | A | | 7/1999 | Kehley et al. | 439/71 |
| 5,930,114 | A | | 7/1999 | Kuzmin et al. | 361/704 |
| 5,955,888 | A | | 9/1999 | Frederickson et al. | 324/761 |
| 5,961,355 | A | | 10/1999 | Morlion et al. | 439/686 |
| 5,971,817 | A | | 10/1999 | Longueville | 439/857 |
| 5,975,921 | A | | 11/1999 | Shuey | 439/83 |
| 5,980,270 | A | | 11/1999 | Fjelstad et al. | 439/71 |
| 5,980,321 | A | | 11/1999 | Cohen et al. | 439/608 |
| 5,984,726 | A | | 11/1999 | Wu | 439/607 |
| 5,993,259 | A | | 11/1999 | Stokoe et al. | 439/608 |
| 6,012,948 | A | | 1/2000 | Wu | 439/567 |
| 6,050,862 | A | | 4/2000 | Ishii | 439/843 |
| 6,059,170 | A | | 5/2000 | Jimarez et al. | 228/119 |
| 6,068,520 | A | | 5/2000 | Winings et al. | 439/676 |
| 6,071,152 | A | | 6/2000 | Achammer et al. | 439/733.1 |
| 6,077,130 | A | | 6/2000 | Hughes et al. | 439/862 |
| 6,089,878 | A | | 7/2000 | Meng | 439/79 |
| 6,095,827 | A | | 8/2000 | Dutkowsky et al. | 439/83 |
| 6,123,554 | A | | 9/2000 | Ortega et al. | 439/79 |
| 6,125,535 | A | | 10/2000 | Chiou et al. | 29/883 |
| 6,139,336 | A | | 10/2000 | Olson | 439/83 |
| 6,146,157 | A | | 11/2000 | Lenoir et al. | 439/101 |
| 6,146,202 | A | | 11/2000 | Ramey et al. | 439/608 |
| 6,146,203 | A | | 11/2000 | Elco et al. | 439/608 |
| 6,152,756 | A | | 11/2000 | Huang et al. | 439/342 |
| 6,174,198 | B1 | | 1/2001 | Wu et al. | 439/541.5 |
| 6,180,891 | B1 | | 1/2001 | Murdeshwar | 174/260 |
| 6,183,287 | B1 | | 2/2001 | Po | |
| 6,183,301 | B1 | | 2/2001 | Paagman | 439/608 |
| 6,190,213 | B1 | | 2/2001 | Reichart et al. | 439/736 |
| 6,193,537 | B1 | | 2/2001 | Harper, Jr. et al. | 439/291 |
| 6,196,871 | B1 | | 3/2001 | Szu | 439/571 |
| 6,202,916 | B1 | | 3/2001 | Updike et al. | 228/180 |
| 6,210,197 | B1 | | 4/2001 | Yu | 439/342 |
| 6,210,240 | B1 | | 4/2001 | Comerci et al. | 439/853 |
| 6,212,755 | B1 | | 4/2001 | Shimada et al. | 29/527.1 |
| 6,215,180 | B1 | | 4/2001 | Chen et al. | 257/720 |
| 6,219,913 | B1 | | 4/2001 | Uchiyama | 29/883 |
| 6,220,884 | B1 | | 4/2001 | Lin | 439/342 |
| 6,220,895 | B1 | | 4/2001 | Lin | 439/607 |
| 6,220,896 | B1 | | 4/2001 | Bertoncini et al. | 439/608 |
| 6,234,851 | B1 | | 5/2001 | Phillips | 439/825 |
| 6,257,478 | B1 | | 7/2001 | Straub | 228/6.2 |
| 6,259,039 | B1 | | 7/2001 | Chroneos, Jr. et al. | 174/263 |
| 6,269,539 | B1 | | 8/2001 | Takahashi et al. | 29/883 |
| 6,274,474 | B1 | | 8/2001 | Caletka et al. | 438/613 |
| 6,293,827 | B1 | | 9/2001 | Stokoe et al. | 439/608 |
| 6,299,492 | B1 | | 10/2001 | Pierini et al. | 439/884 |
| 6,309,245 | B1 | | 10/2001 | Sweeney | 439/507 |
| 6,319,075 | B1 | * | 11/2001 | Clark et al. | 439/825 |
| 6,328,602 | B1 | | 12/2001 | Yamasaki et al. | 439/608 |
| 6,347,952 | B1 | | 2/2002 | Hasegawa et al. | 439/608 |
| 6,350,134 | B1 | | 2/2002 | Fogg et al. | 439/79 |
| 6,359,783 | B1 | | 3/2002 | Noble | 361/704 |
| 6,360,940 | B1 | | 3/2002 | Bolde et al. | 228/264 |
| 6,362,961 | B1 | | 3/2002 | Chiou | 361/704 |
| 6,363,607 | B1 | | 4/2002 | Chen et al. | 29/883 |

| | | | | |
|---|---|---|---|---|
| 6,371,773 | B1 | 4/2002 | Crofoot et al. | 439/79 |
| 6,379,188 | B1 | 4/2002 | Cohen et al. | 439/608 |
| 6,386,924 | B2 | 5/2002 | Long | 439/701 |
| 6,409,543 | B1 | 6/2002 | Astbury, Jr. et al. | 439/608 |
| 6,428,328 | B2 | 8/2002 | Haba et al. | 439/70 |
| 6,431,914 | B1 | 8/2002 | Billman | 439/608 |
| 6,435,914 | B1 | 8/2002 | Billman | 439/608 |
| 6,461,202 | B2 | 10/2002 | Kline | 439/701 |
| 6,471,523 | B1 | 10/2002 | Shuey | 439/63 |
| 6,471,548 | B2 | 10/2002 | Bertoncini et al. | 439/608 |
| 6,506,081 | B2 | 1/2003 | Blanchfield et al. | 439/682 |
| 6,514,103 | B2 | 2/2003 | Pape et al. | 439/608 |
| 6,537,111 | B2 | 3/2003 | Brammer et al. | 439/857 |
| 6,544,046 | B1 | 4/2003 | Hahn et al. | 439/83 |
| 6,551,112 | B1 | 4/2003 | Li et al. | 439/66 |
| 6,554,647 | B1 | 4/2003 | Cohen et al. | 439/607 |
| 6,572,410 | B1 | 6/2003 | Volstorf et al. | 439/608 |
| 6,592,381 | B2 | 7/2003 | Cohen et al. | 439/80 |
| 6,652,318 | B1 | 11/2003 | Winings et al. | 439/608 |
| 6,663,426 | B2 | 12/2003 | Hasircoglu et al. | 439/608 |
| 6,665,189 | B1 | 12/2003 | Lebo | 361/730 |
| 6,669,514 | B2 | 12/2003 | Wiebking et al. | 439/701 |
| 6,672,907 | B2 | 1/2004 | Azuma | 439/682 |
| 6,692,272 | B2 | 2/2004 | Lemke et al. | 439/108 |
| 6,702,594 | B2 | 3/2004 | Lee et al. | 439/83 |
| 6,705,902 | B1 | 3/2004 | Yi et al. | 439/678 |
| 6,712,621 | B2 | 3/2004 | Li et al. | 439/65 |
| 6,716,068 | B2 | 4/2004 | Wu | 439/733.1 |
| 6,740,820 | B2 | 5/2004 | Cheng | 174/260 |
| 6,743,037 | B2 | 6/2004 | Kassa et al. | 439/342 |
| 6,746,278 | B2 | 6/2004 | Nelson et al. | 439/608 |
| 6,769,883 | B2 | 8/2004 | Brid et al. | |
| 6,769,935 | B2 | 8/2004 | Stokoe et al. | 439/608 |
| 6,776,635 | B2 | 8/2004 | Blanchfield et al. | 439/181 |
| 6,776,649 | B2 | 8/2004 | Pape et al. | 439/485 |
| 6,790,088 | B2 | 9/2004 | Ono et al. | 439/607 |
| 6,796,831 | B1 | 9/2004 | Yasufuku et al. | 439/485 |
| 6,811,440 | B1 | 11/2004 | Rothermel et al. | 439/608 |
| 6,829,143 | B2 | 12/2004 | Russell et al. | 361/704 |
| 6,835,103 | B2 | 12/2004 | Middlehurst et al. | 439/699.1 |
| 6,843,687 | B2 | 1/2005 | McGowan et al. | 439/608 |
| 6,848,886 | B2 | 2/2005 | Schmaling et al. | 416/134 |
| 6,848,950 | B2 * | 2/2005 | Allison et al. | 439/682 |
| 6,848,953 | B2 | 2/2005 | Schell et al. | 439/825 |
| 6,869,294 | B2 | 3/2005 | Clark et al. | 439/79 |
| 6,884,117 | B2 | 4/2005 | Korsunsky et al. | 439/607 |
| 6,905,367 | B2 | 6/2005 | Crane et al. | 439/608 |
| 6,929,504 | B2 | 8/2005 | Ling et al. | 439/485 |
| 6,947,012 | B2 | 9/2005 | Aisenbrey | 343/906 |
| 6,975,511 | B1 | 12/2005 | Lebo et al. | 361/703 |
| 6,994,569 | B2 * | 2/2006 | Minich et al. | 439/79 |
| 7,001,189 | B1 | 2/2006 | McGowan et al. | 439/79 |
| 7,070,464 | B2 | 7/2006 | Clark et al. | 439/825 |
| 7,074,096 | B2 | 7/2006 | Copper et al. | 439/843 |
| 7,101,228 | B2 | 9/2006 | Hamner et al. | 439/637 |
| 7,104,812 | B1 | 9/2006 | Bogiel et al. | 439/79 |
| 7,114,963 | B2 | 10/2006 | Shuey et al. | 439/79 |
| 7,168,963 | B2 | 1/2007 | Minich et al. | 439/79 |
| 7,182,642 | B2 | 2/2007 | Ngo et al. | 439/608 |
| D542,736 | S | 5/2007 | Riku | D13/147 |
| 7,273,382 | B2 | 9/2007 | Igarashi et al. | |
| 2001/0003685 | A1 | 6/2001 | Aritani | 439/485 |
| 2002/0106930 | A1 | 8/2002 | Pape et al. | 439/485 |
| 2002/0142676 | A1 | 10/2002 | Hosaka et al. | 439/874 |
| 2002/0159235 | A1 | 10/2002 | Miller et al. | 361/704 |
| 2002/0193019 | A1 | 12/2002 | Blanchfield et al. | 439/857 |
| 2003/0013330 | A1 | 1/2003 | Takeuchi | 439/83 |
| 2003/0143894 | A1 | 7/2003 | Kline et al. | 439/608 |
| 2003/0219999 | A1 | 11/2003 | Minich et al. | 439/79 |
| 2003/0220021 | A1 | 11/2003 | Whiteman, Jr. et al. | 439/608 |
| 2003/0236035 | A1 | 12/2003 | Kuroda et al. | 439/857 |
| 2004/0183094 | A1 | 9/2004 | Caletka et al. | 257/178 |
| 2005/0112952 | A1 | 5/2005 | Wang et al. | 439/660 |
| 2006/0003620 | A1 * | 1/2006 | Daily et al. | 439/295 |
| 2006/0281354 | A1 | 12/2006 | Ngo et al. | 439/290 |

FOREIGN PATENT DOCUMENTS

| | | | |
|---|---|---|---|
| DE | 102 26 279 | C1 | 11/2003 |
| EP | 0 273 683 | A2 | 7/1988 |
| EP | 0 321 257 | B1 | 4/1993 |
| EP | 0 623 248 | B1 | 11/1995 |
| EP | 0 789 422 | A2 | 8/1997 |
| EP | 1 091 449 | B1 | 9/2004 |
| GB | 1 162 705 | | 8/1969 |
| JP | 06-236788 | | 8/1994 |
| JP | 07-114958 | | 5/1995 |
| JP | 0 812 5379 | | 5/1996 |
| JP | 2000-003743 | | 1/2000 |
| JP | 2000-003744 | | 1/2000 |
| JP | 2000-003745 | | 1/2000 |
| JP | 2000-003746 | | 1/2000 |
| JP | 2003-217785 | | 7/2003 |
| TW | 576555 | | 8/1991 |
| TW | 546872 | | 8/2003 |
| WO | WO 97/43885 | | 11/1997 |
| WO | WO 97/44859 | | 11/1997 |
| WO | WO 98/15989 | | 4/1998 |
| WO | WO 01/29931 | A1 | 4/2001 |
| WO | WO 01/39332 | A1 | 5/2001 |

OTHER PUBLICATIONS

Sherman, L.M., "Plastics that Conduct Heat", Plastics Technology Online, Jun. 2001, http://www.plasticstechnology.com, 4 pages.

Ogando, J., "And now-An Injection-Molded Heat Exchanger", Sure, plastics are thermal insulators, but additive packages allow them to conduct heat instead, Global Design News, Nov. 1, 2000, 4 pages.

In the United States Patent and Trademark Office, Office Action Summary for U.S. Appl. No. 11/358,168, filed Aug. 15, 2007, 7 pages.

In the United States Patent and Trademark Office, Office Action Summary for U.S. Appl. No. 11/358,168, filed May 11, 2007, 22 pages.

In the United States Patent and Trademark Office, Office Action Summary for U.S. Appl. No. 11/358,168, filed Jan. 16, 2007, 24 pages.

* cited by examiner

CONNECTORS AND CONTACTS FOR TRANSMITTING ELECTRICAL POWER

CROSS REFERENCE TO RELATED APPLICATIONS

This application is related to U.S. application Ser. No. 11/019,777, filed Dec. 21, 2004; and U.S. application Ser. No. 11/408,437, filed Apr. 21, 2006. The contents of each of these applications is incorporated by reference herein in its entirety.

FIELD OF THE INVENTION

The present invention relates to electrical connectors, and contacts used therein, that are configured to transmit electrical power.

BACKGROUND OF THE INVENTION

Connector systems for transmitting electrical power typically comprise a header connector, and a receptacle connector that mates with and receives a portion of the header connector. The header connector can include one or more power contacts that engage complementary one or more power contacts on the receptacle connector, to establish electrical and mechanical contact between the header and receptacle connectors.

The power contacts used in the header connector are usually configured differently than the power contacts used in the receptacle connector, due to the need to equip the power contacts of the two connectors with complementary mating features.

The requirement to manufacture two different types of power contacts for a header connector and a receptacle connector can necessitate the use of a second set of production tooling that would not otherwise be required. Assembly costs can also be driven higher by the use of two different types of power contacts, as different processes and machinery may be required to assemble the two types of power contacts.

The parts count, and the amount of inventory needed to support production can be greater for a connector system that includes two, rather than one type of power contact. Also, the use of two different types of power contacts can introduce the potential for human error in the production and assembly processes. For example, a power contact configured for the header connector may be erroneously installed in the receptacle connector when different types of power contacts are used in the header and receptacle connectors.

Consequently, an ongoing need exists for a connector system having the same type of power contacts in a header connector and a receptacle connector thereof.

SUMMARY OF THE INVENTION

Preferred embodiments of connector systems include a first connector, and a second connector that mates with the first connector. The same type of power contact is used in the first and second connectors.

Preferred embodiments of power contacts comprise a first half having a first plate-like body member, and a first type of contact beam adjoining the first body member; and a second half having a second plate-like body member positioned beside the first body member, and a second type of contact beam adjoining the second body member and opposing the first type of contact beam.

Other preferred embodiments of power contacts comprise a straight contact beam, and an angled contact beam opposing and spaced apart from the straight contact beam.

Other preferred embodiments of connector systems comprise a first connector having a first housing, and a first power contact disposed in the first housing. The connector systems also comprise a second connector having a second housing, and a second power contact disposed in the second housing. The second power contact is matable with and substantially identical to the first power contact.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DETAILED DESCRIPTION OF ILLUSTRATIVE EMBODIMENTS

Figure 1:
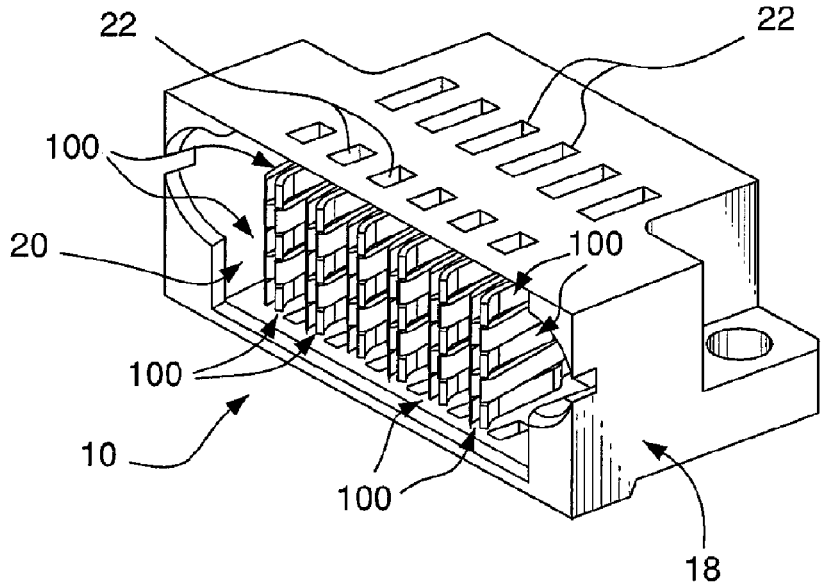
FIG. 1 is a front perspective view of a header connector of a preferred embodiment of a connector system.
Figure 2:
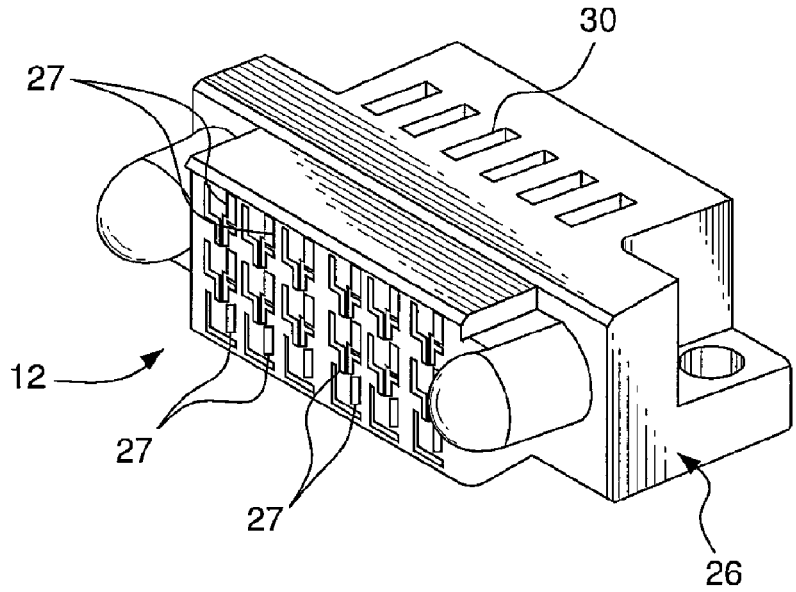
FIG. 2 is a front perspective view of a receptacle connector that mates with the header connector shown in FIG. 1.
Figure 3:
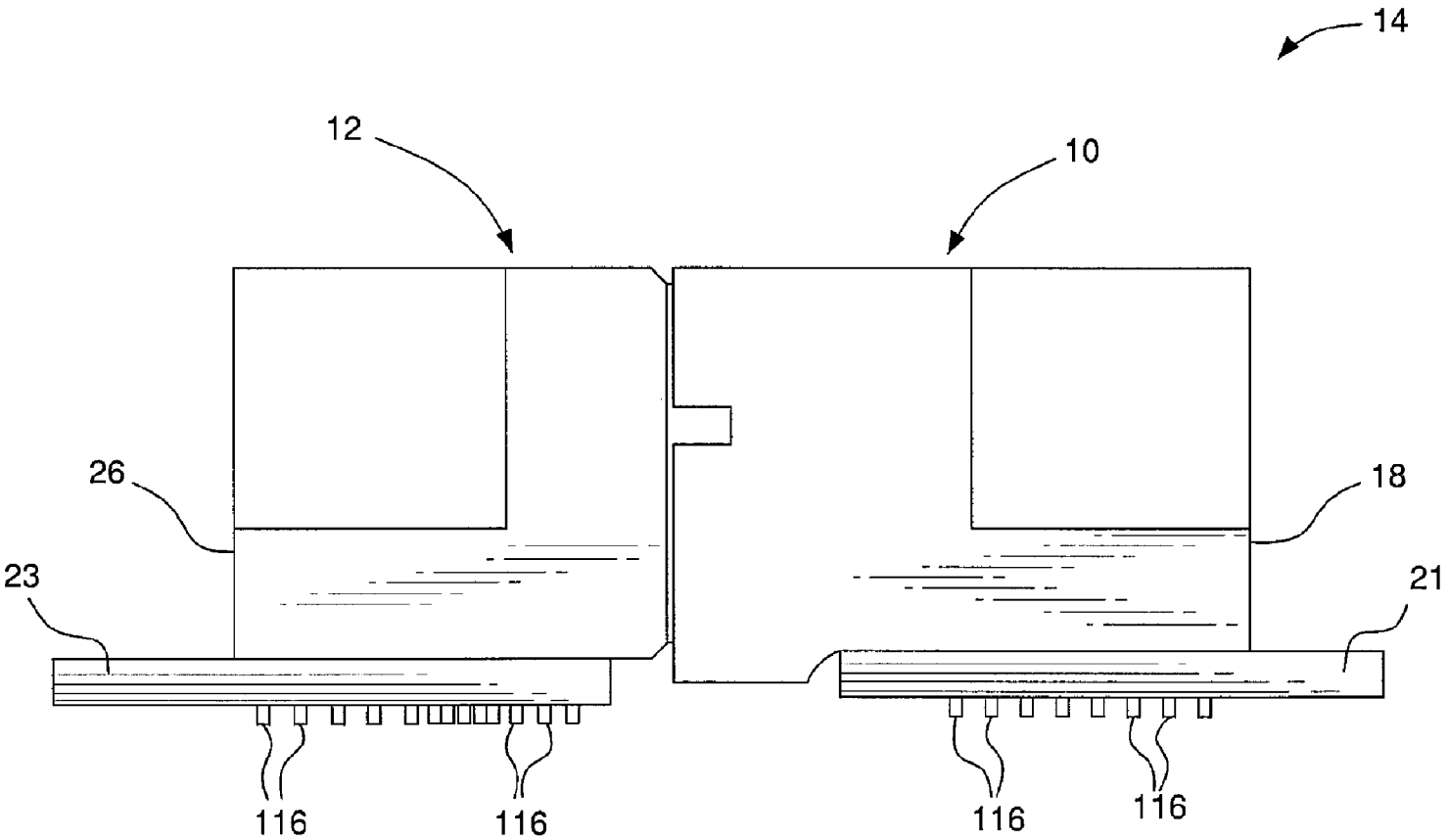
FIG. 3 is a side view of the header and receptacle connectors shown in FIGS. 1 and 2 in a mated condition.

FIGS. 1 and 3 depict a preferred embodiment of a header connector 10. The header connector 10 comprises a plurality of power contacts 100. FIGS. 2 and 3 depict a preferred embodiment of a receptacle connector 12 that mates with the header connector 10. The receptacle connector 12 comprises a plurality of power contacts that are identical to, and mate with the power contacts 100 of the header connector 10. For clarity of illustration, the power contacts of the receptacle connector 12 are denoted by the reference character 100*a* in the figures. The header connector 10 and the receptacle connector 12 form a connector system 14.

The header connector 10 is depicted with six of the power contacts 100 for exemplary purposes only. Alternative embodiments of the header connector 10 can include more, or less than six of the power contacts 100. For example, alternative embodiments can include only one of the power contacts 100.

The header connector 10 can be mounted on a substrate 21, and the receptacle connector 12 can be mounted on a substrate 23, as shown in FIG. 3. The header and receptacle connectors 10, 12, when mated, can transmit electrical power between the substrates 21, 22.

The header connector 10 further comprises a housing 18. The housing 18 defines a cavity 20 in which the power contacts 100 are disposed. The housing 18 can have apertures 22 formed therein. Each aperture 22 extends between the cavity 20 and an upper exterior surface of the housing 18, from the perspective of FIG. 1. The apertures 22 help to dissipate heat generated by the transmission of electrical current through the power contacts 100, by channeling heated air from the cavity 20 to the environment around the header connector 10.

The receptacle connector 20 further comprises a housing 26. The housing 26 defines a cavity (not shown) in which the power contacts 100*a* are disposed. The housing 26 has openings 27 formed therein, to provide access to the power contacts 100*a* from the mating face of the housing 26.

The housing 26 can have apertures 30 formed therein. Each aperture 30 extends between the cavity within the housing 26, and an upper exterior surface of the housing 26. The apertures 30 help to dissipate heat generated by the transmission of electrical current through the power contacts 100*a*, by channeling heated air from the cavity to the environment around the receptacle connector 12.

The housing 18 and the housing 26 are preferably formed from an electrically and thermally-insulative material such as glass-filled high-temperature nylon. Alternative embodiments of the housing 18 and the housing 26 can be formed from materials that are not thermally insulative.

Details of the housing 18 and the housing 26 are presented for exemplary purposes only. The power contacts 100, 100*a* can be used in conjunction with other types of connector housings.

The power contacts 100 of the header connector 10 and the power contacts 100*a* of the receptacle connector 12 are identical, as discussed above. The following description of the power contact 100 therefore applies equally to the power contact 100*a*, unless otherwise noted.

Figure 4:
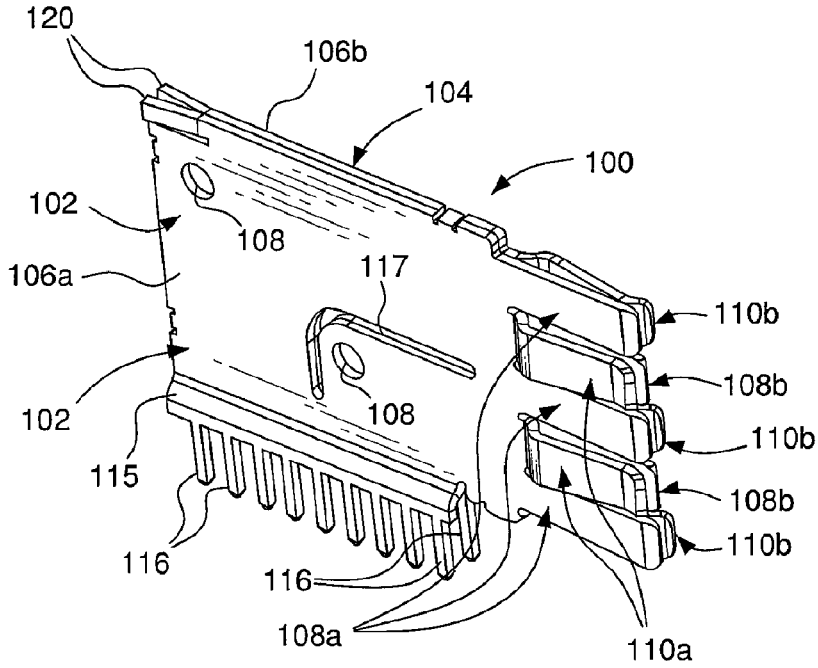
FIG. 4 is a front perspective view of a power contact of the header connector shown in FIGS. 1 and 3.
Figure 5:
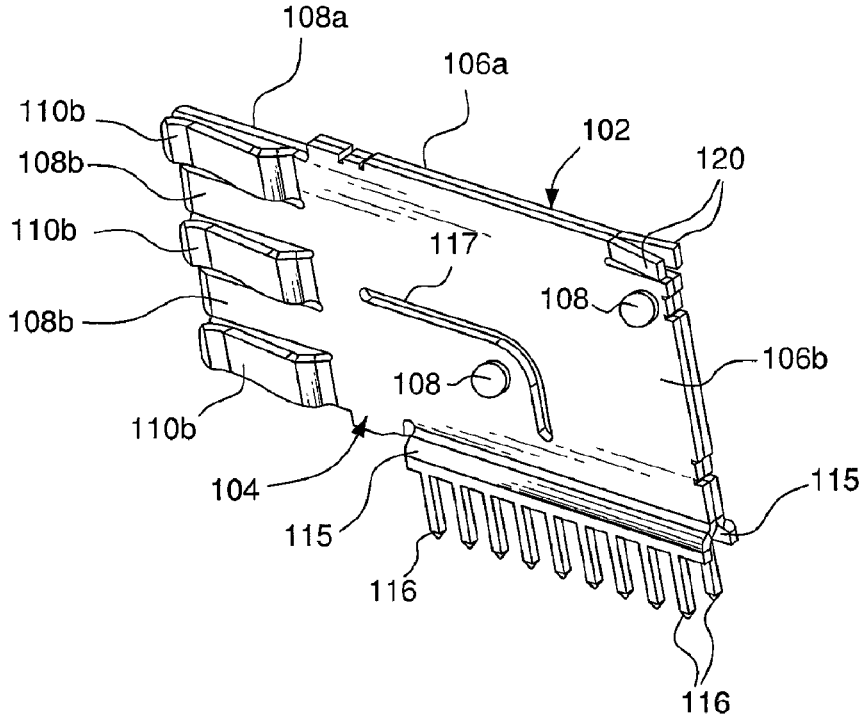
FIG. 5 is a rear perspective view of the power contact shown in FIG. 4.
Figure 6:
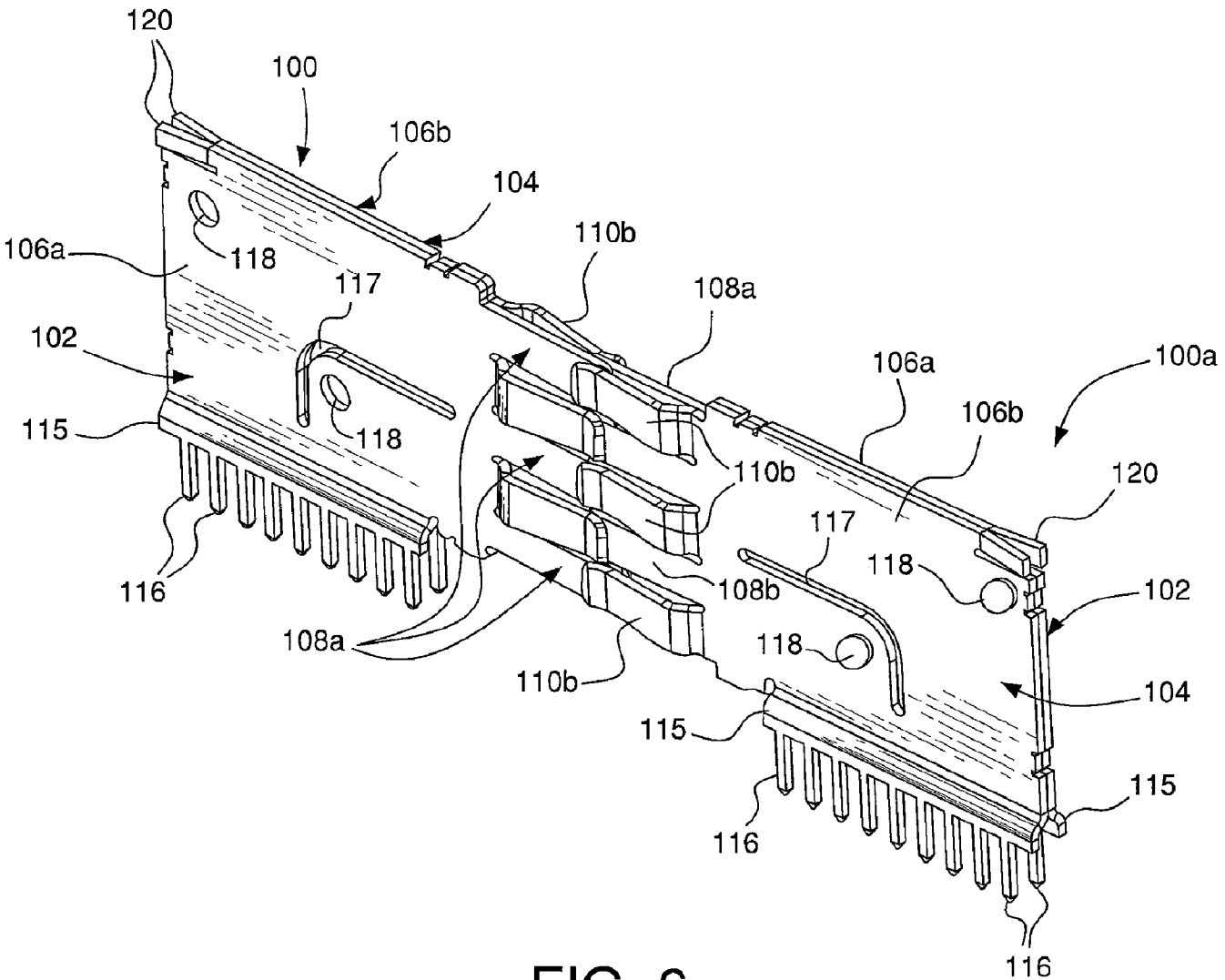
FIG. 6 is a perspective view of the power contact shown in FIGS. 4 and 5, at the start of a mating sequence with an identical power contact of the receptacle connector shown in FIGS. 2 and 3.

Each power contact 100 includes a first half 102 and a second half 104. The first half 102 includes a plate-like body member 106*a*. The second half 104 includes a plate-like body member 106*b*. The body members 106*a*, 106*b* oppose, or face each other, and are stacked against each other as shown in FIGS. 4 and 5. The body members 106*a*, 106*b* can be configured so that all, or a portion of the body member 106*a* is spaced apart from the body member 106*b* in alternative embodiments of the power contact 100.

The first portion 102 includes a first type of contact beam in the form of three substantially straight contact beams 108*a*. The contact beams 108*a* each adjoin a forward end of the body member 106*a*, from the perspective of FIG. 4. The second portion 104 includes two substantially straight contact beams 108*b* that each adjoin a forward end of the body member 108*b*. A forward edge of each straight contact beam 108*a*, 108*b* is preferably rounded or curved, shown in FIGS. 7 and 8.

Figure 7:
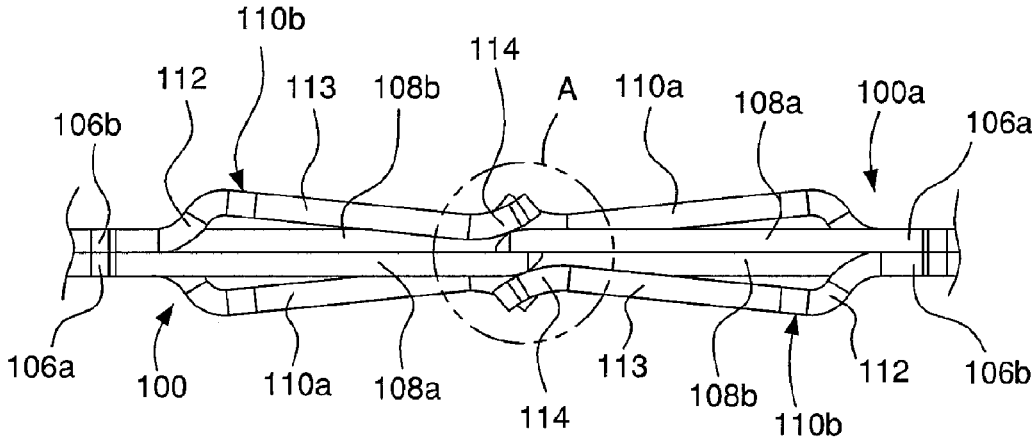
FIG. 7 is a top view of the power contacts shown in FIGS. 4-6, at the start of the mating sequence.

The first portion 102 further includes a second type of contact beam in the form of two angled contact beams 110*a* The second portion 104 further includes three angled contact beams 110*b*. Each angled contact beam 110*a*, 110*b* includes a substantially S-shaped portion 112 that adjoins the forward end of the associated body member 106*a*, 106*b* as shown in FIG. 7. Each angled contact beam 110*a*, 110*b* also includes a straight portion 113 that adjoins the associated angled portion 112, and a curved portion 114 that adjoins the associated straight portion 113. This configuration causes each of the angled contact beams 110*a*, 110*b* to extend outwardly and then inwardly along a length thereof.

The first half 102 of the power contact 100 is depicted with three of the straight contact beams 108*a* and two of the angled contact beams 110*a* for exemplary purposes only. The second half 104 is depicted with two of the straight contact beams 108*b* and three of the angled contact beams 110*b* for exemplary purposes only. Alternative embodiments of the power contact 100 can include first and second halves 102, 104 having any number of the straight contact beams 108*a*, 108*b* and angled contact beams 110*a*, 110*b*, including a single straight contact beam 108*a*, 108*b* and/or a single angled contact beam 110*a*, 110*b*.

The straight contact beams 108*a* and the angled contact beams 110*a* of the first half 102 are preferably arranged on the body member 106*a* in an alternating manner, i.e., each angled contact beam 110*a* is positioned adjacent to, and between two straight contact beams 108*a* as shown in FIG. 4. The straight contact beams 108*b* and the angled contact beams 110*b* of the second half 104 of the power contact 100 are preferably arranged on the body member 106*b* in an alternating manner, i.e., each straight contact beam 108*b* is positioned adjacent to, and between two of the angled contact beams 110*b* as shown in FIG. 5.

Each straight contact beam 108*a* of the first half 102 opposes, and is spaced apart from an associated one of the angled contact beams 110*b* of the second half 104, as shown in FIG. 4. This arrangement results in three pairs of opposing straight and angled contact beams 108*a*, 110*b*.

Each angled contact beam 110*a* of the first half 102 opposes, and is spaced apart from an associated one of the straight contact beams 108*b* of the second half 104. This arrangement results in two sets of opposing straight and angled contact beams 108*b*, 110*a*.

Each of the first and second halves 102, 104 preferably includes a substantially S-shaped portion 115 that adjoins a bottom edge of the body member 106*a*, 106*b*, as shown in FIGS. 4 and 5.

Each of the first and second halves 102, 104 also includes a plurality of terminal pins 116 that adjoin an associated one of the substantially S-shaped portions 115. The terminal pins 116 can be received in plated through holes or other features of the substrate 21 or the substrate 23, to establish electrical and mechanical contact between the header or receptacle connectors 10, 12 and the respective substrates 21, 23. The substantially S-shaped portions 115 each jog or flare outwardly in relation to their associated body member 106*a*, 106*b*, to provide an offset between the terminal pins 116 of the first half 102 and the terminal pins 116 of the second half 104.

The power contact 100 is depicted as a right angle contact for exemplary purposes only. Alternative embodiments of the power contact 100 can be configured with the terminal portions 115 extending directly or indirectly from a rearward edge of the associated body member 106*a*, 106*b*.

Each of the body members 106*a*, 106*b* can include current-guiding features, such as a slot 117 shown in FIGS. 4 and 5, to encourage even distribution of the electrical current flowing through the power contact 100 during operation thereof. Alternative embodiments of the power contact 100 can be formed without current-guiding features.

One or both of the body members 106*a*, 106*b* can include one or more projections 118. The projections 118 can be received in associated through holes formed in the other body member 106*a*, 106*b*, to help maintain the first and second halves 102, 104 in a state of alignment as the power contact 100 is inserted into the housing 18. Alternative embodiments of the power contact 100 can be formed without such alignment features.

Each body member 106*a*, 106*b* can include a tab 120 located at an upper rearward corner thereof. The tab 120 is angled outward, as shown in FIGS. 4 and 5. Each tab 120 can contact an associated lip (not shown) on the housing 18 as the power contact 100 is inserted into the housing 18 from the rearward side thereof during assembly of the header connector 10. Contact between the tab 120 and the lip causes the tab 120 to deflect inward. The tab 120 clears the lip as the power contact 100 approaches its fully-inserted position within the housing 18. The resilience of the tab 120 causes the tab 120 to spring outward, to its original position, once the tab 120 clears the lip. Interference between the tab 120 the lip can discourage the power contact 100 from backing out of the housing 18.

The power contact 100 can be formed from suitable materials known to those skilled in the art of electrical connector design. For example, the power contact can formed from a copper alloy. Other materials can be used in the alternative. The power contact 100 can be plated with various materials including, for example, gold, or a combination of gold and nickel.

The power contacts 100 of the header connector 10 can each mate with an identical power contact 100*a* of the receptacle connector 12, as discussed above. FIGS. 6 through 10 depict the mating sequence of the power contacts 100, 100*a*.

The header connector 10 and the receptacle connector 12 are initially positioned so that the straight contact beams 108*a*, 108*b* and the angled contact beams 110*a*, 110*b* of the header connector 10 substantially align with associated openings 27 in the housing 26 of the receptacle connector 12. Movement of the header and receptacle connectors 10, 12 toward each other causes the forward edges of the straight contact beams 108*a*, 108*b* and the angled contact beams 110*a*, 110*b* of the header connector 10 to enter the housing 26 by way of the openings 27.

The forward edge of each straight contact beam 108*a* of the power contact 100*a* enters the space, or gap between an associated pair of opposing straight and angled contact beams 108*a*, 110*b* of the power contact 100 as the plug and receptacle connectors 10, 12 are moved further toward each other. The forward edge of each straight contact beam 108*a* of the power contact 100 simultaneously enters the space between an associated pair of opposing straight and angled contact beams 108*a*, 110*b* of the power contact 100*a* as the power contacts 100, 100*a* are moved toward each other.

Figure 8:
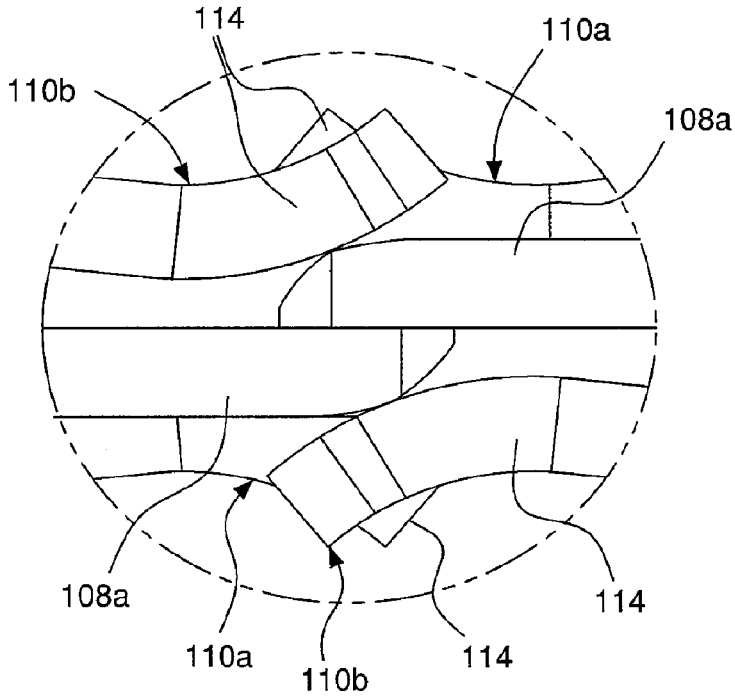
FIG. 8 is a magnified view of the area designated "A" in FIG. 7.

Further movement of the power contacts 100, 100*a* toward each other causes each straight contact beam 108*a* to contact a curved portion 114 of an associated one of the angled contact beams 110*b*, as shown in FIGS. 7 and 8. Each pair of opposing straight and angled contact beams 108*a*, 110*b* is spaced apart so that the insertion therebetween of the associated straight contact beam 108*a* of the other power contact 100, 100*a* causes the angled contact beam 110*b* to deflect outwardly.

The rounded forward edge of each straight contact beam 108*a* can help to guide the straight contact beam 108*a* into the space between the associated pair of straight and angled contact beams 108*a*, 110*b* of the other power contact 100, 100*a*. In addition, the rounded forward edge urges the contacting angled contact beam 110*b* outward in a gradual manner.

Figure 10:
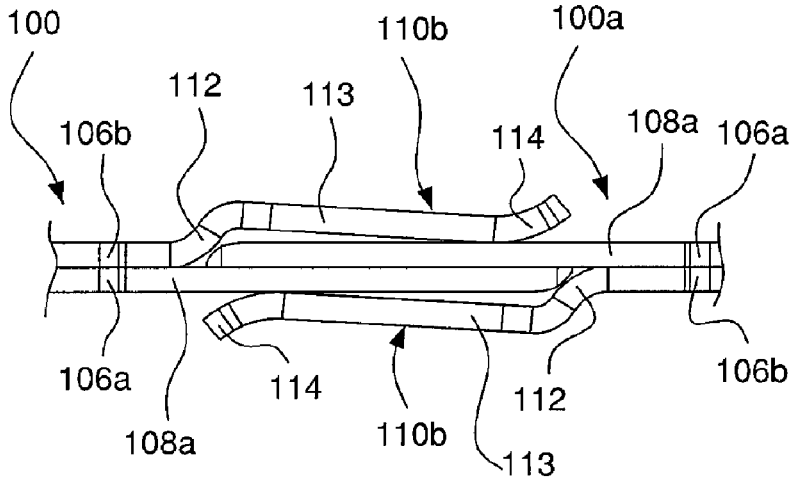
FIG. 10 is a magnified top view of the area designated "B" in FIG. 9.
Figure 9:
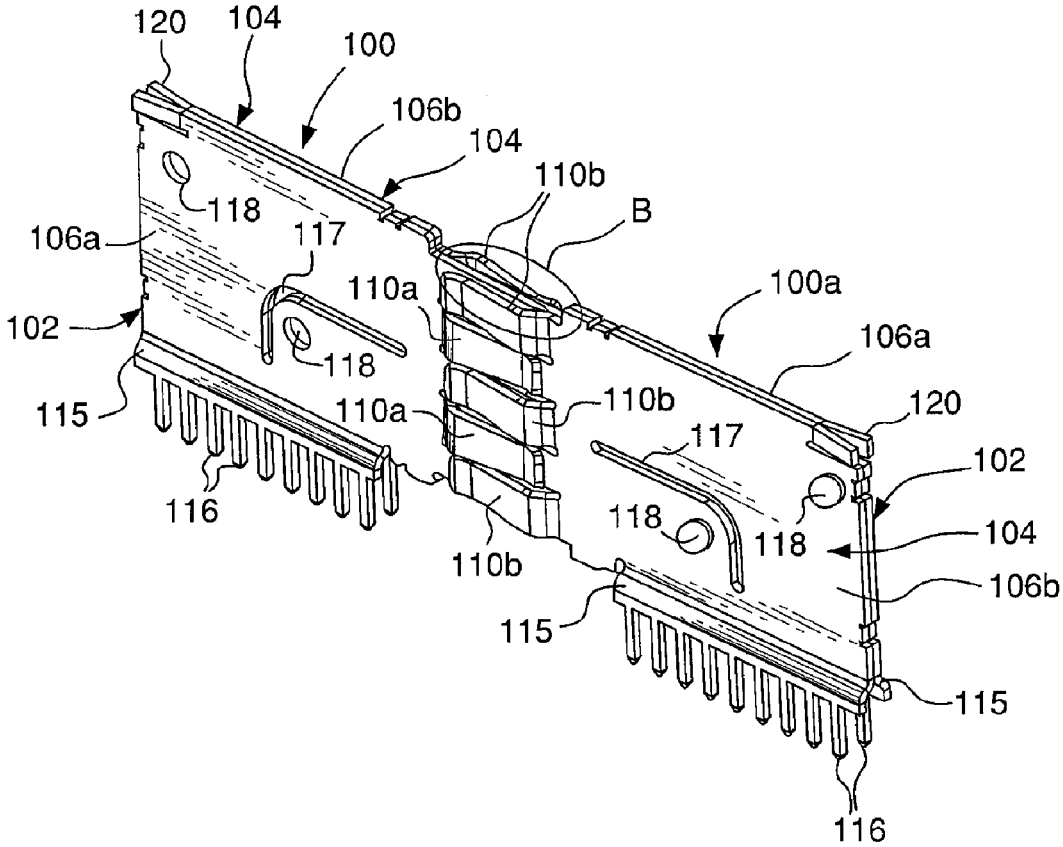
FIG. 9 is a perspective view of the power contacts shown in FIGS. 4-8, in a fully mated condition.

Continued movement of the power contacts 100, 100*a* toward each other causes the power contacts 100, 100*a* to eventually reach their fully mated positions depicted in FIGS. 9 and 10.

The straight contact beams 108*a* of both power contacts 100, 100*a* are disposed between the associated angled contact beams 110*b* of the power contacts 100, 100*a* when the power contacts 100, 100*a* are fully mated as shown in FIGS. 9 and 10. The angled contact beams 110*b* are spread outward by the straight contact beams 108*a*. The resilient deflection of the angled contact beams 110*a* generates a contact force between each angled contact beam 110*a*, and the contacting straight contact beam 108*a*. The contact forces urge the associated straight contact beams 108*a* against each other, and thus gives rise to an additional contact force between the straight contact beams 108*a*. These contact forces help to establish electrical contact between the power contacts 100, 100*a*. The contact forces also help to maintain the power contacts 100, 100*a* in a mated condition.

The power contacts 100, 100*a* can be configured so that the associated straight contact beams 108*a* are initially separated by a gap that closes as the above-noted contact forces urge the straight contact beams 108*a* toward each other, i.e., the associated straight contact beams 108*a* can deflect inwardly as the power contacts 100, 100*a* are mated. Alternatively, the power contacts 100, 100*a* can be configured so that the associated straight contact beams 108*a* contact each other at the start of the mating process, and remain in contact throughout the mating process.

The mating sequence for the straight contact beams 108*b* and the angled contact beams 110*a* of the power contacts 100, 100*a* is substantially identical to, and occurs on a simultaneous basis with the above described mating sequence for the straight contact beams 108*a* and the angled contact beams 110*b*.

The use of identical power contacts in a pair of header and receptacle connectors can obviate the need for two different sets of tooling to manufacture the power contacts, and can thereby help to minimize tooling costs. In addition, the use of identical power contacts can help to minimize production assembly costs, as the same processes and machinery can be used to assemble the power contacts of both the header and receptacle connectors.

The use of identical power contacts in the header and receptacle connectors of a connector system can help to minimize the amount of inventory needed to support production of the connector system, further reducing overall production costs. Moreover, the potential for human error associated with the use of different type of power contacts in a header and receptacle connector can be eliminated through the use of identical power contacts therein. For example, the use of identical power contacts in the header and receptacle connectors can substantially eliminate the possibility that a power contact suitable for use only in the header connector will mistakenly be installed in the receptacle connector.

The foregoing description is provided for the purpose of explanation and is not to be construed as limiting the invention. Although the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

Figure 11:
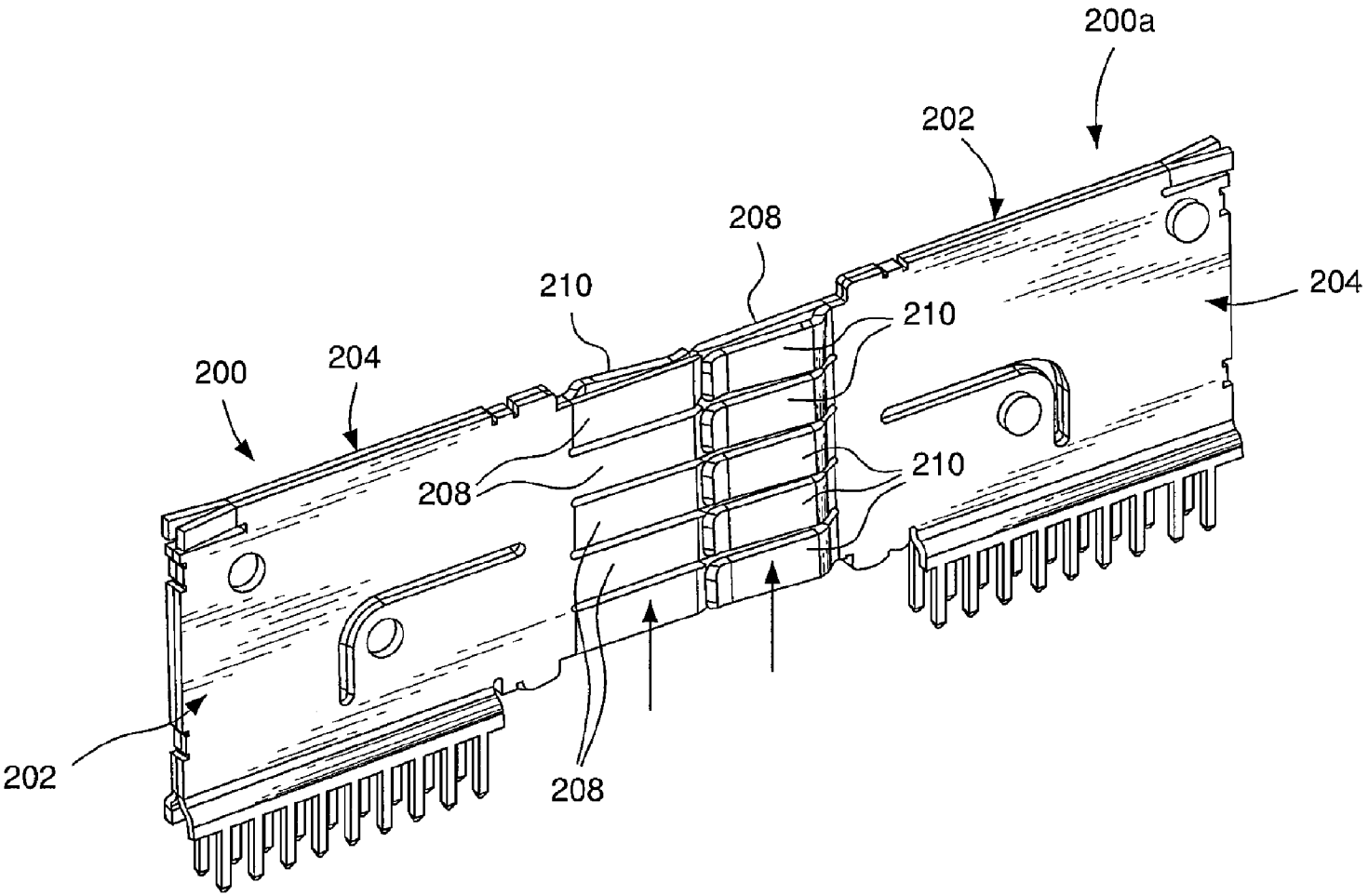
FIG. 11 is a perspective view of an alternative embodiment of the power contacts shown in FIGS. 4-10, at the start of a mating sequence.
Figure 13:
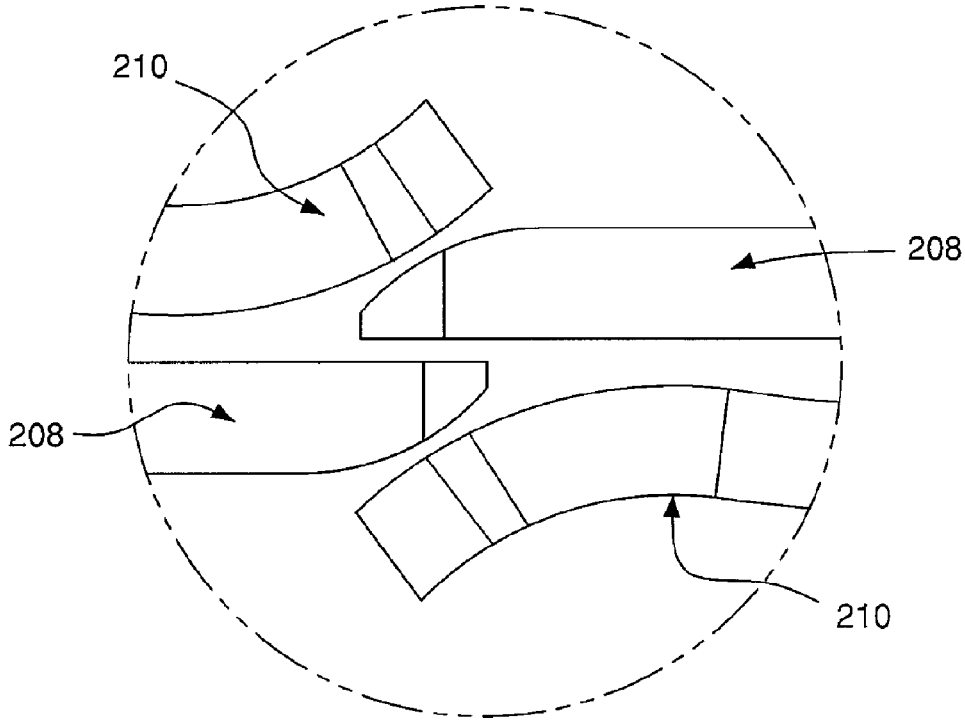
FIG. 13 is a magnified view of the area designated "C" in FIG. 12.
Figure 12:
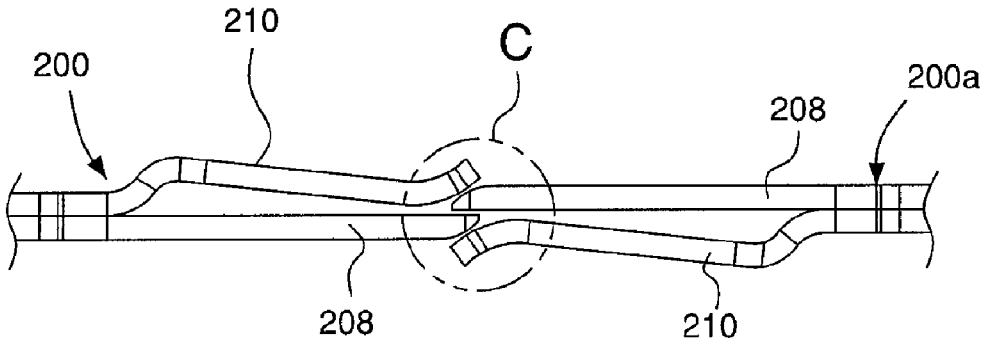
FIG. 12 is a top view of the power contacts shown in FIG. 11, at the start of the mating sequence.

For example, FIGS. 11 through 13 depict an alternative embodiment of the power contacts 100, 100*a* in the form of power contacts 200, 200*a*. The power contacts 200, 200*a* are substantially identical to the power contact 100, with the exception that all of the straight contact beams 208 of the power contacts 200, 200*a* are positioned on a first half 202 of the power contacts 200, 200*a*, and all of the angled contact beams 210 of the power contacts 200, 200*a* are positioned on a second half 204 of the power contacts 200, 200*a*. The angled contact beams 210 and the straight contact beams 208 otherwise are substantially identical to the respective angled contact beams 110*a*, 110*b* and straight contact beams 108*a*, 108*b* of the power contact 100.

Figure 14:
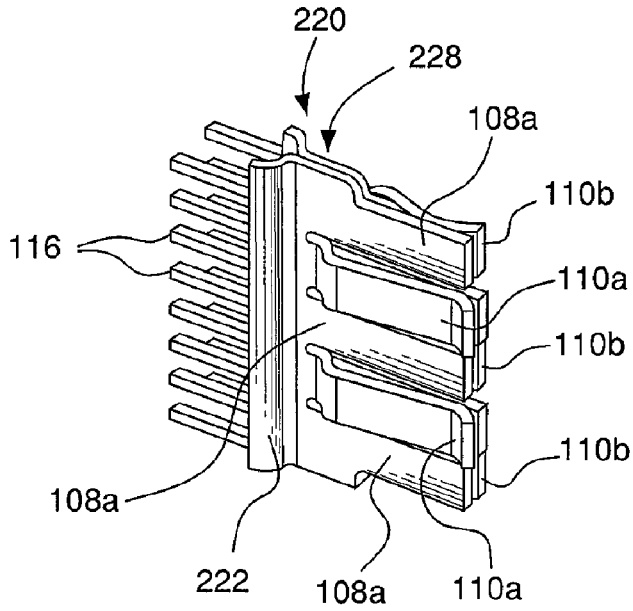
FIG. 14 is a perspective view of another alternative embodiment of the power contacts shown in FIGS. 4-10.

FIG. 14 depicts another alternative embodiment of the power contact 100 in the form of a power contact 220. The power contact 220 includes a first half 222 having three of the straight contact beams 108*a* and two of the angled contact beams 110*a* arranged as described above in relation to the power contact 100. The power contact 220 also includes a second half 228 having two of the straight contact beams 108*b* and three of the angled contact beams 110*b* arranged as described above in relation to the power contact 100.

Figure 15:
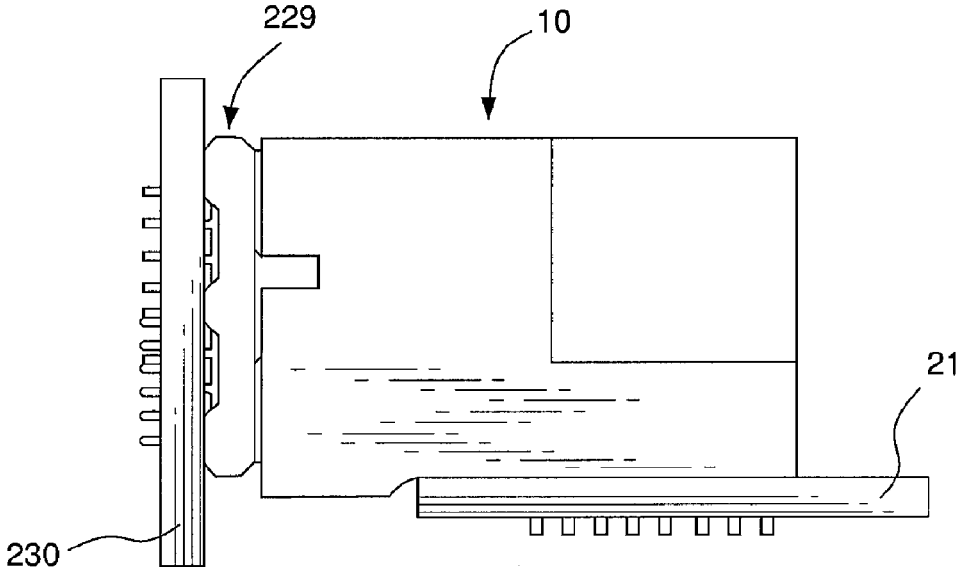
FIG. 15 is a side view of a receptacle connector that includes the power contact shown in FIG. 14, mated with the header connector shown in FIGS. 1 and 3.

The power contact 220 includes terminal pins 116 that extend rearward from the first and second halves 222, 228. The power contact 220 can be used as part of a receptacle connector 229 shown in FIG. 15. The receptacle connector 229 can mate with the header connector 10, and can be mounted on a substrate 230 that is substantially perpendicular to the substrate 21.

Figure 16:
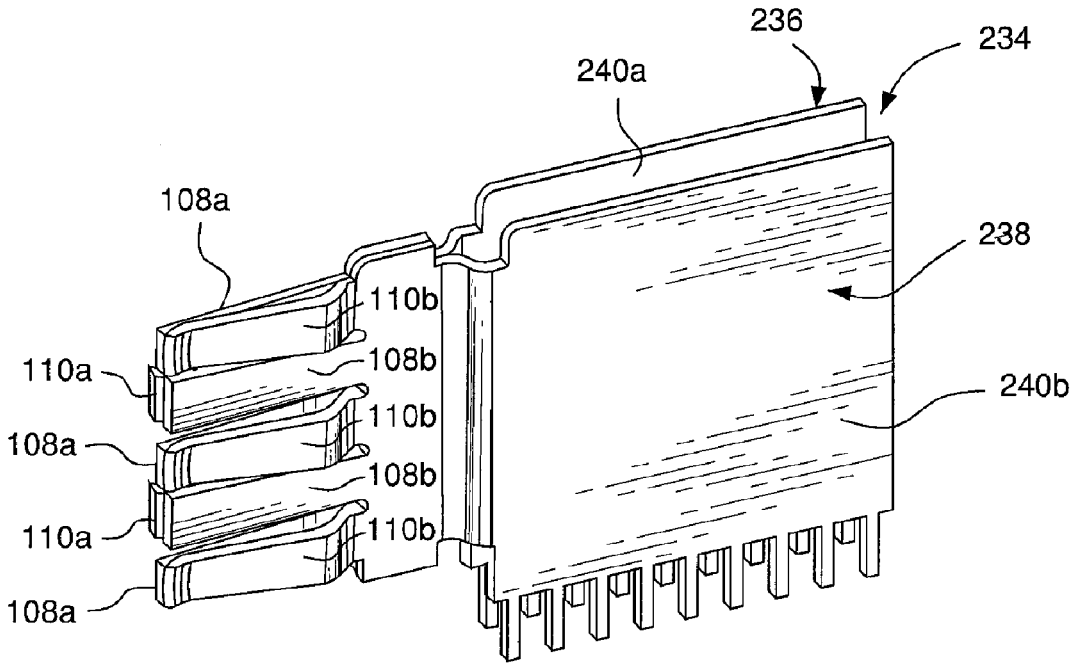
FIG. 16 is a perspective view of another alternative embodiment of the power contacts shown in FIGS. 4-10.

FIG. 16 depicts another alternative embodiment of the power contact 100 in the form of a power contact 234. The power contact 234 includes a first half 236 and a second half 238. The first half 236 comprises a plate-like body member 240*a*, and the second half 238 comprises a plate-like body member 240*b*. The body members 240*a*, 240*b* are spaced apart as shown in FIG. 16. Spacing the body members 240, 240*b* can help to dissipate heat from the power contact 234 during operation.

The first half 236 of the connector 234 can include three of the straight contact beams 108*a* and two of the angled contact beams 110*a*, arranged as described above in relation to the power contact 100. The second half 238 of the connector 234 can include two of the straight contact beams 108*b* and three of the angled contact beams 110*b*, arranged as described above in relation to the power contact 100.

Figure 17:
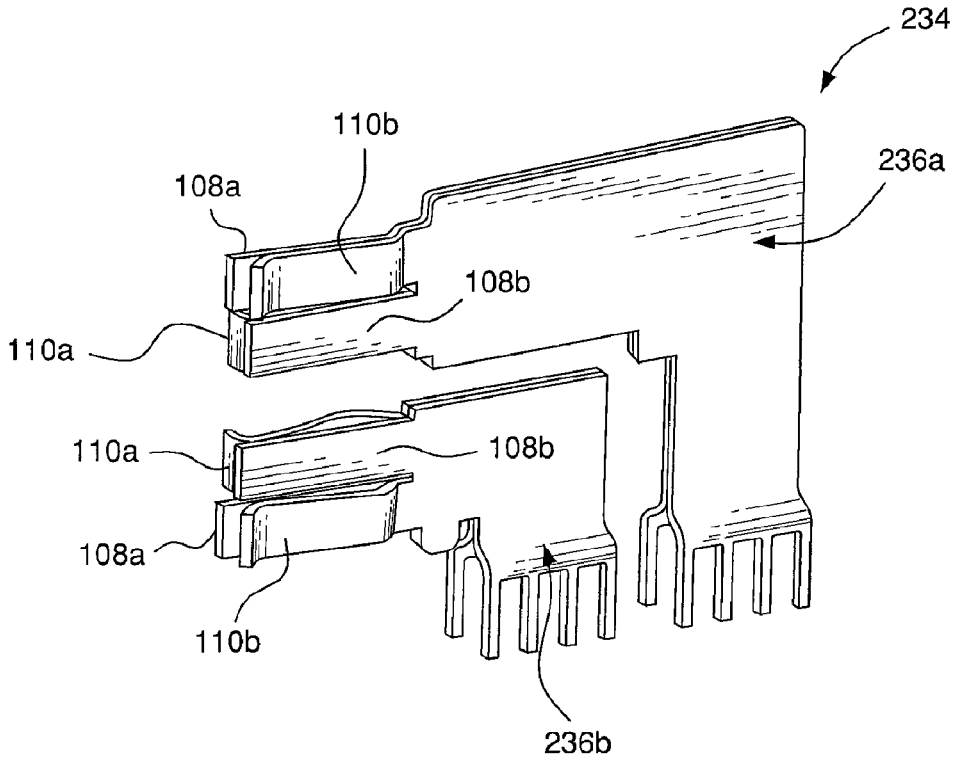
FIG. 17 is a perspective view of another alternative embodiment of the power contacts shown in FIGS. 4-10.

FIG. 17 depicts another alternative embodiment of the power contact 100 in the form of a power contact 234. The power contact 234 is substantially similar to the power contact 100, with the exception that the power contact 234 is divided into an upper half 236*a* and a spaced-apart lower half 236*b*, to encourage even distribution of the electrical current that flows through the power contact 234 during operation thereof. The power contact 234 includes straight contact beams 108*a*, 108*b* and opposing angled contact beams 110*a*, 110*b*, arranged in the manner discussed above in relation to the power contact 100.

Figure 18:
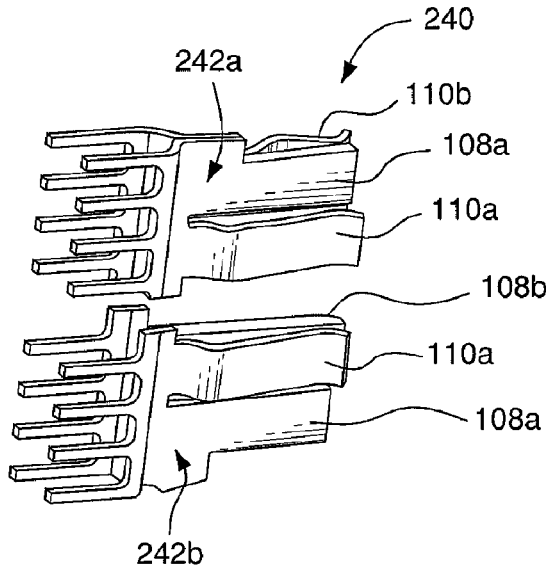
FIG. 18 is a perspective view of another alternative embodiment of the power contacts shown in FIGS. 4-10.

FIG. 18 depicts another alternative embodiment of the power contact 100 in the form of a power contact 240. The power contact 240 is substantially similar to the power contact 220, with the exception that the power contact 240 is divided into an upper half 242*a* and a spaced-apart lower half 242*b*, to encourage even distribution of the electrical current that flows through the power contact 240 during operation thereof. The power contact 240 includes straight contact beams 108*a*, 108*b* and opposing angled contact beams 110*a*, 110*b*, arranged in the manner discussed above in relation to the power contact 100.

Figure 19:
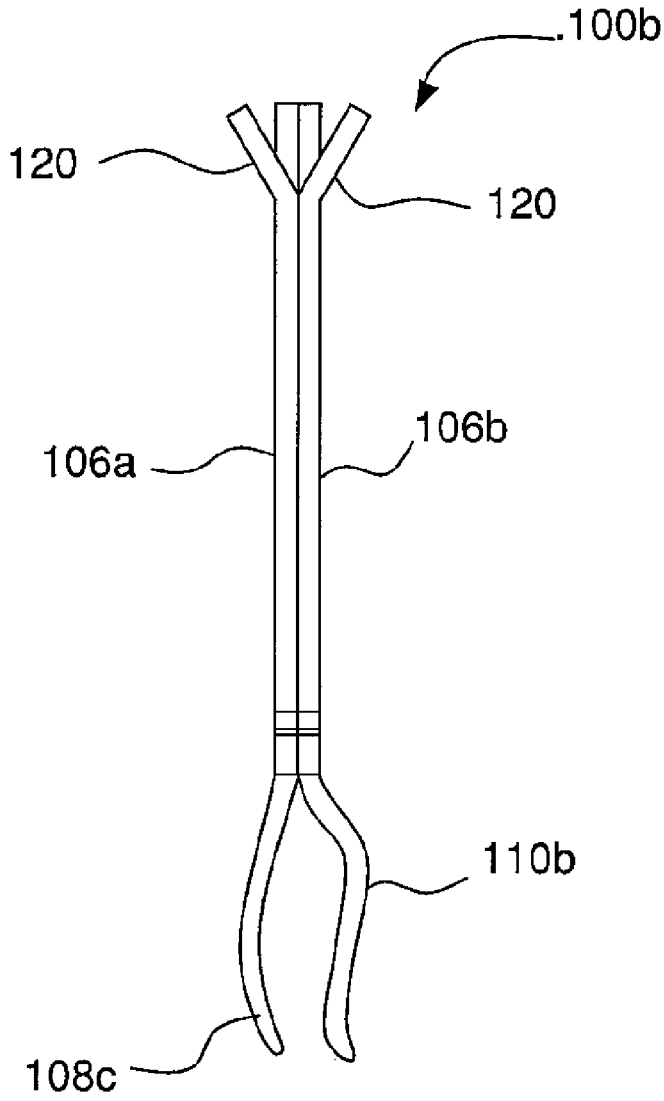
FIG. 19 is a top view of another alternative embodiment of the power contacts shown in FIGS. 4-10.

The first type of contact beams of the power contact 100 are depicted as straight contact beams 108*a*, 108*b* for exemplary purposes only. The first type of contact beams can have a configuration other than straight in alternative embodiments. For example, FIG. 19 depicts a power contact 100*b* comprising a first type of contact beam 108*c* having an arcuate shape in the lengthwise direction thereof. Components of the power contact 100*b* that are identical to those of the power contact 100 are denoted by identical reference characters in the figures. Only one contact beam 108*c* and one angled contact beam 110*b* are depicted in FIG. 19, for clarity of illustration. Other geometric configurations for the first type of contact beams can be used in other alternative embodiments.

Figure 20A:
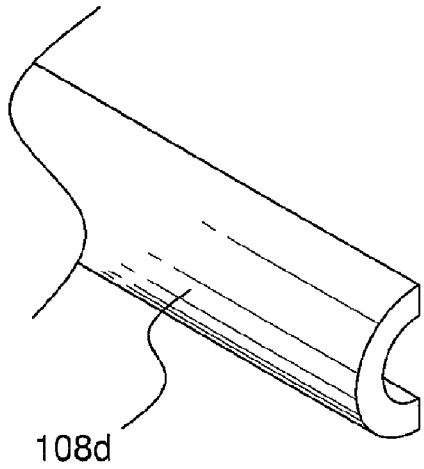
FIG. 20A is a front perspective view of a first type of contact beam of another alternative embodiment of the power contacts shown in FIGS. 4-10.
Figure 20B:
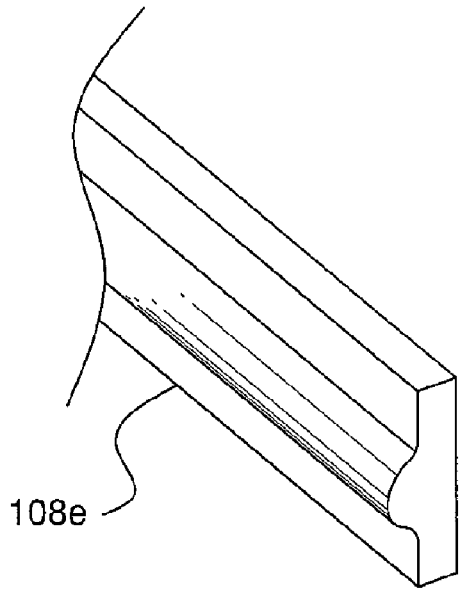
FIG. 20B is a front perspective view of a first type of contact beam of another alternative embodiment of the power contacts shown in FIGS. 4-10.

Moreover, the straight contact beams 108*a*, 108*b* are depicted as having a rectangular transverse cross section for exemplary purposes only. The first type of contact beams 108*a*, 108*b* of alternative embodiments can have transverse cross sections other than rectangular. For example, FIG. 20A depicts a first type of contact beam 108*d* having an arcuate transverse cross-section. FIG. 20B depicts a first type of contact beam 108*e* having a thickness that varies along the height of the contact beam 108*e*. Contact beams having other type of transverse cross sections can be used in other alternative embodiments. Moreover, the angled contact beams 110*a*, 110*b* can also be formed with cross sections other than rectangular in alternative embodiments.

Alternative embodiments (not shown) of the header and receptacle connectors 12, 14 can include one or more arrays of signal contacts. The signal-contact arrays can be positioned between, or to one side of the power contacts 100, 100*a*.

What is claimed:

1. A power contact, comprising:

a first half comprising a first plate-like body member, a straight contact beam adjoining the first plate-like body member and having a major surface, and an angled contact beam adjoining the first plate-like body member and having a major surface; and a second half comprising a second plate-like body member that is substantially parallel to the first plate-like body member, an angled contact beam adjoining the second plate-like body member and having a major surface opposing the major surface of the straight contact beam of the first half, and a straight contact beam adjoining the second plate-like body member and having a major surface opposing the major surface of the angled contact beam of the first half.

2. The power contact of claim 1, wherein (i) the angled contact beam of the first half first extends outwardly from the first plate-like body member and then inwardly along a length of the angled contact beam, and (ii) the angled contact beam of the second half first extends outwardly from the second plate-like body member and then inwardly along a length of the angled contact beam.

3. The power contact of claim 1, wherein the plate-like body member of the first half is stacked against the plate-like body member of the second half.

4. The power contact of claim 1, wherein the first half further comprises a terminal pin that extends in a direction substantially perpendicular to a longitudinal axis of the contact beams extending from the first plate-like body member, and the second half further comprises another terminal pin that extends in a direction substantially perpendicular to a longitudinal axis of the contact beams extending from the second plate-like body member.

5. The power contact of claim 1, wherein a forward edge of each of the straight and angled contact beams is rounded.

6. The power contact of claim 1, wherein:

the first half further comprises three of the straight contact beams and two of the angled contact beams adjoining the first plate-like body member and arranged in an alternating manner on the first plate-like body member; and the second half further comprises two of the straight contact beams and three of the angled contact beams adjoining the second plate-like body member and arranged in an alternating manner on the second plate-like body member.

7. A power contact, comprising:

a first plate;

a second plate that is substantially parallel to the first plate;

a first straight contact beam being electrically and mechanically connected to the first plate, the first straight contact beam having a major surface;

a second straight contact beam being electrically and mechanically connected to the first plate, the second straight contact beam having a major surface;

a first angled contact beam being electrically and mechanically connected to the second plate, the first angled contact beam having a major surface opposing and spaced apart from the major surface of the first straight contact beam; and a second angled contact beam being electrically and mechanically connected to the second plate, the second angled contact beam having a major surface opposing and spaced apart from the major surface of the second straight contact beam.

8. The power contact of claim 7, wherein (i) the first angled contact beam first extends outwardly from the first plate and then inwardly along a length of the first angled contact beam, and (ii) the second angled contact beam first extends outwardly from the first plate and then inwardly along a length of the second angled contact beam.

9. The power contact of claim 8, wherein each angled contact beam comprises:

a curved portion disposed at a free end of the angled contact beam;

a straight portion extending from the curved portion; and an S-shaped portion connecting the straight portion to the second plate.

10. A connector system, comprising:

a first connector comprising a first housing, and a first power contact disposed in the first housing, the first power contact having at least four contact beams; and a second connector comprising a second housing, and a second power contact disposed in the second housing, the second power contact having at least four contact beams, wherein the second power contact is matable with and identical to the first power contact wherein (i) the first and second power contacts each comprise a first type of contact beams, and a second type of contact beams, (ii) the first type of contact beams of the first power contact oppose the second type of contact beams of the second power contact, and (iii) the first type of contact beams of the second power contact oppose the second type of contact beams of the first power contact.

11. The connector system of claim 10, wherein the first type of contact beams are straight and the second type of contact beams are angled.

12. The connector system of claim 10, wherein each of the first and second power contacts further comprises:

a first half comprising at least one of the first type of contact beams and at least one of the second type of contact beams; and a second half comprising at least one of the first type of contact beams that opposes the second type of contact beam of the first half, and at least one of the second type of contact beams that opposes the first type of contact beam of the first half.

13. The connector system of claim 10, wherein the first connector is a header connector and the second connector is a receptacle connector.

14. The connector system of claim 10, wherein:

the first type of contact beams of the second power contact become disposed between respective first and second types of contact beams of the first power contact when the first and second connectors are mated; and the first type of contact beams of the first power contact become disposed between respective first and second types of contact beams of the second power contact when the first and second connectors are mated.

15. The connector system of claim 14, wherein the first type of contact beams of the first power contact and the first type of contact beams of the second power contact cause the second type of contact beams of the first power contact and the second type of contact beams of the second power contact to deflect outward when the first and second connectors are mated whereby a contact force is generated between the first and second power contacts.

* * * * *